United States Patent [19]

Nelson et al.

[11] Patent Number: 4,878,280

[45] Date of Patent: Nov. 7, 1989

[54] APPARATUS AND PROCESS FOR INTERMINGLING FILAMENT YARNS

[75] Inventors: Thomas L. Nelson, Georgetown, Del.; Lynn B. Thomas, Sr., Rhodesdale, Md.

[73] Assignee: E. I. Du Pont De Nemours and Company, Wilmington, Del.

[21] Appl. No.: 227,771

[22] Filed: Aug. 2, 1988

[51] Int. Cl.[4] ..... D02J 1/08

[52] U.S. Cl. ..... 28/274

[58] Field of Search ..... 28/272, 274; 57/350

[56] References Cited

U.S. PATENT DOCUMENTS

| | | | |
|---|---|---|---|
| 3,333,313 | 8/1967 | Gilmore et al. | 28/272 X |
| 3,971,108 | 7/1976 | Gorrafa | 28/272 |
| 3,978,558 | 9/1976 | Pike | 28/274 |
| 4,011,640 | 3/1977 | Keith . | |
| 4,063,338 | 12/1977 | Wyatt | 28/274 X |
| 4,125,922 | 11/1978 | Irwin . | |
| 4,437,301 | 3/1984 | Eschenbach et al. . | |
| 4,452,035 | 6/1984 | Rohner et al. | 28/274 X |
| 4,505,013 | 3/1985 | Nelson . | |

FOREIGN PATENT DOCUMENTS

| | | | |
|---|---|---|---|
| 233939 | 6/1961 | Australia | 28/271 |
| 4912145 | 2/1974 | Japan | 28/271 |
| 5322181 | 7/1978 | Japan . | |
| 58-104239 | 6/1983 | Japan | 28/271 |
| 59-32573 | 8/1984 | Japan | 28/271 |
| 6170063 | 4/1986 | Japan | 28/271 |
| 6183341 | 4/1986 | Japan | 28/271 |

*Primary Examiner*—Robert R. Mackey

[57] ABSTRACT

This invention relates to an apparatus and a process involving fluid jet devices for intermingling filaments of a continuous filament yarn or yarns, including combining a plurality of yarns to produce a larger coherent yarn. More particularly, the invention relates to fluid jets having a passageway through which yarn moves, where the yarn is positioned and maintained along one wall as it passes through the passageway and where the fluid-directing orifice in the jet is offset with respect to the passageway in the direction of the wall. The apparatus and the process are useful in producing heather yarns with superior yarn blending and along-end uniformity.

8 Claims, 3 Drawing Sheets

APPARATUS AND PROCESS FOR INTERMINGLING FILAMENT YARNS

FIELD OF THE INVENTION

This invention relates to the manufacture of coherent yarns from multiple filaments. More particularly, it relates to fluid jet devices useful for intermingling filaments.

BACKGROUND OF THE INVENTION

Fluid jet filament intermingling devices have long been used to make twist-free coherent yarns and also to combine a plurality of yarns into a single coherent yarn having the filaments of the various yarns intermingled with one another. Most such interlacing or entangling patents show the yarn being guided straight through the center of the fluid jet device, and even where it is taught to bend the yarn at guides before and after the jet, the yarn is still centered in the jet as it moves through the yarn passageway of the jet.

Other patents describe jet designs aimed at achieving improved entanglement by bending the yarn at one location in or on the jet itself, and still others show the yarn bending in opposite directions at the jet entrance and exit. The orifice in these jets is typically centered with respect to the yarn passageway. Although useful in the production of a variety of different yarns, these jets do not produce consistently uniform intermingling. Lack of uniformity is a serious drawback when intermingling two or more yarns of different color or dyeability to make products of blended shades known as heather yarns.

A different type of intermingling device is shown in U.S. Pat. No. 4,505,013 (Nelson) wherein yarn approaching an entangling jet is enclosed in a tube to constrain lateral vibrations of the yarn. While the latter device is quite effective, the yarn cannot be strung up through the device while the yarn is running. In addition, the only means of selectively varying the degree of intermingling is to adjust the fluid pressure which also affects the uniformity of intermingling. A jet which can overcome these problems and produce heather yarns with consistently uniform intermingling would be highly desirable.

SUMMARY OF THE INVENTION

A process and apparatus useful in achieving heather yarns of improved uniformity has now been discovered. The process is useful in entangling any filament yarn or combination of filament yarns, including in particular nylon, polyester, and polypropylene. More specifically, the process of this invention provides a method for intermingling filaments of a yarn or yarns wherein the running yarn or yarns are overfed at about 5–25% into an elongated passageway, defined by at least one wall, where the yarn is directed along the wall while proceeding through the passageway. While in the passageway, the yarn is exposed to a fluid stream from an orifice offset from the longitudinal axis of the passageway in the direction of the running yarn.

The invention also provides an apparatus for entangling or intermingling filaments of a yarn or yarns comprising a block having an elongated passageway through which yarn can move, said passageway being defined by an entrance and an exit connected by at least one wall; means for maintaining the yarn against one wall as the yarn moves through the passageway; and an orifice in the block for directing a fluid stream into said passageway wherein the orifice is positioned so as to be offset with respect to the longitudinal axis of the passageway in the direction of the wall, i.e. in the direction of the running yarn. In preferred embodiments, the orifice is aligned so as to be substantially perpendicular to the passageway and is either substantially rectangular or, less preferably, circular in cross-section.

Though many alternatives are feasible, one means useful for maintaining the yarn against the wall of the passageway is to fix yarn guides outside both the entrance and the exit to the passageway. The guides can be placed in a manner which will keep the yarn along the appropriate wall as it is fed into the entrance and removed from the exit of the passageway.

The block is preferably comprised of an orifice plate in which the orifice is situated and a mating, removable cap assembly which in turn consists of an adjustable yarn passage plate, a cap plate, and a tee handle for holding all three plates of the block together. In this embodiment, the passageway is formed by the interface of a yarn passage groove in the adjustable yarn passage plate of the cap assembly with a portion of the surface of the orifice plate. The location of the orifice with respect to the passageway is then set by adjusting the position of the yarn passage groove. One means for making this adjustment is a close-fitting gauge pin inserted into the orifice and having a portion of larger radius, the difference in radii between the two cylindrical portions being equal to the desired offset between the orifice and one wall of the yarn passage groove, there being means for fixing the groove in its adjusted position while removing and replacing the cap assembly during normal operation. Such adjustability permits selecting a desired degree of intermingling at a given fluid pressure while maintaining good along-end yarn uniformity.

DETAILED DESCRIPTION OF THE DRAWINGS

Figure 1:
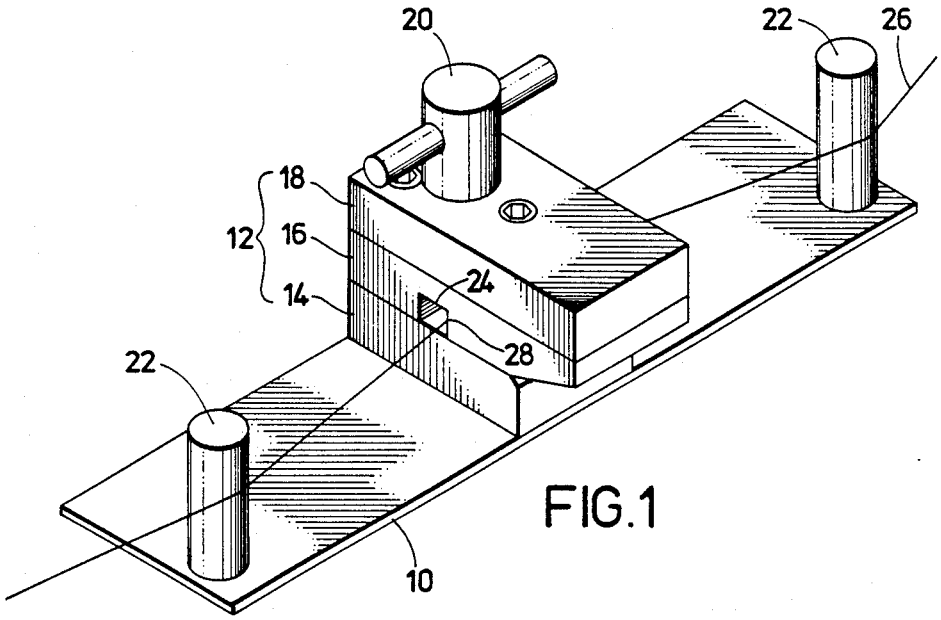
FIG. 1 is a perspective view of an apparatus of the invention shown assembled and in operation.

Considering the figures in greater detail, FIG. 1 depicts an apparatus of the invention mounted on base 10 with block 12 shown as being formed by orifice plate 14, adjustable yarn passage plate 16 and cap plate 18.

The three plates are, in turn, held together by tee handle 20. Yarn guides 22 are located away from the center line of yarn passageway 24 so that yarn 26 will be forced toward contact with wall 28 of yarn passageay 24 at both the entrance and the exit of the passageway.

Figure 2:
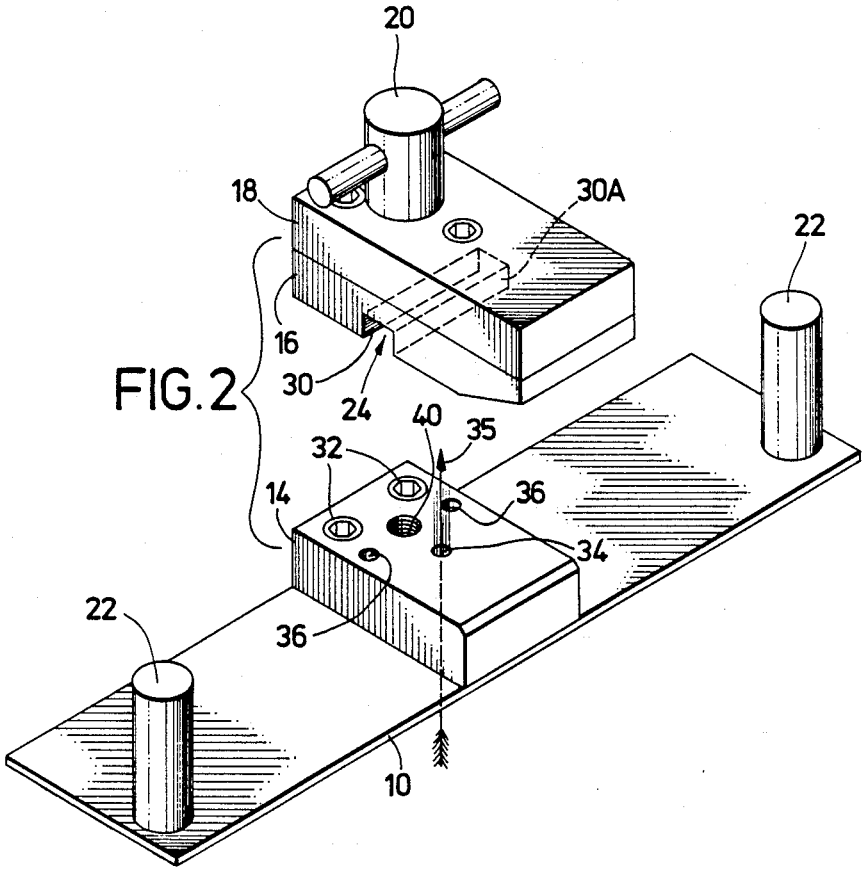
FIG. 2 shows a cap assembly removed from an orifice plate.

Referring to FIG. 2, orifice plate 14 is secured to base 10 by screws 32. Fluid orifice 34 is supplied with fluid, such as air or water, from a source not shown. The fluid passes through the orifice, shown as being substantially perpendicular to yarn passageway 24, in the direction indicated by arrow 35. Alignment pin holes 36 receive the lower ends of alignment pins 38 shown in FIG. 3A. Tee screw hole 40 receives the lower threaded end of tee handle 20. Adjustable yarn passage plate 16, cap plate 18 and tee handle 20 are shown here as a single cap assembly, as they will be in normal operation. Also shown as 30 and 30A are the entrance and exit to the yarn passageway.

Figure 3A:
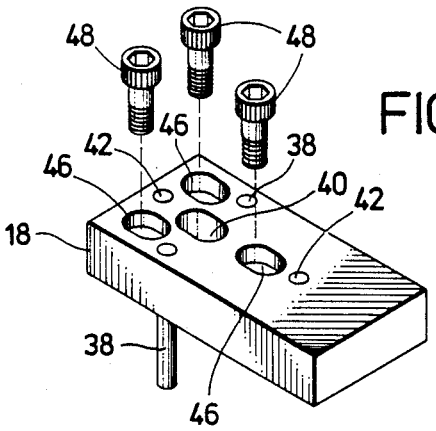
FIG. 3A shows details of a cap plate, a component of a cap assembly.
Figure 3B:
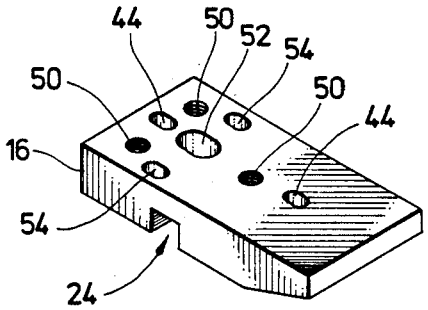
FIG. 3B shows details of an adjustable yarn passage plate, another component of a cap assembly.

Referring to FIG. 3A, cap plate 18 has two alignment pins 38 of sufficient length to extend through the thickness of adjustable yarn passage plate 16 and into alignment pin holes 36 of orifice plate 14. It also has two short alignment pins 42 of sufficient length to engage slotted holes 44 of adjustable yarn passage plate 16 shown in FIG. 3B. Holes 46 for screws 48 are either sufficiently large to accommodate the range of adjustability of cap plate 18 or are slotted. In FIG. 3B, threaded holes 50 receive the lower ends of screws 48; hole 52 has sufficient clearance with tee handle 20 to accommodate adjustability or is slotted; holes 54 are slotted for mating with alignment pins 38, and holes 44 are slotted for mating with short pins 42.

Figure 4A:
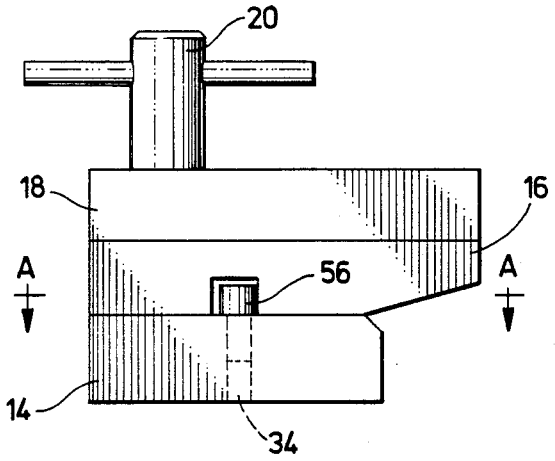
FIG. 4A is an end view of an apparatus of the invention with a gauge pin inserted into the fluid orifice for setting the position of the yarn passage groove with respect to the fluid orifice.
Figure 4B:
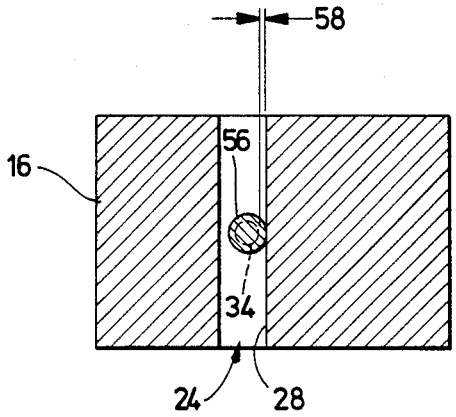
FIG. 4B is a sectional view of FIG. 4A along line A—A, showing an orifice of substantially circular cross-section.

Referring to FIGS. 4A and 4B, this embodiment of the apparatus of the invention may be adjusted for different alignments of yarn passage 24 with respect to fluid orifice 34 by removing the cap assembly and inserting gauge pin 56 into fluid orifice 34 of orifice plate 14. Screws 48, which secure adjustable yarn passage plate 16 to cap plate 18 are loosened, and plate 16 is slid to the right. The cap assembly is then placed over gauge pin 56 with alignment pins 38 engaged in holes 36 and tee handle 20 loosely engaged in hole 40. Plate 16 is then slid to the left to contact the larger diameter of gauge pin 56 while tee handle 20 is tigthened. Screws 48 are then tightened, the cap assembly is removed, and gauge pin 56 is removed, leaving yarn passage groove 24 offset with respect to fluid orifice 34 by the amount indicated as 58.

The adjustable feature is useful when yarns having significantly different entangling characteristics or deniers must be processed or when different degrees of blending are desired, in which case a gauge pin can be fabricated for each desired degree of offset. When the yarns to be processed have sufficiently similar characteristics, the adjustable feature may be eliminated and a one-piece cap assembly may be made with the required degree of offset, using alignment pins 38 and tee handle 20 without screws 48 and short alignment pins 42. An adjustable apparatus may be used for experimental purposes to determine the optimum degree of offset for the products involved and then non-adjustable cap assemblies may be made for routine production.

Figure 4C:
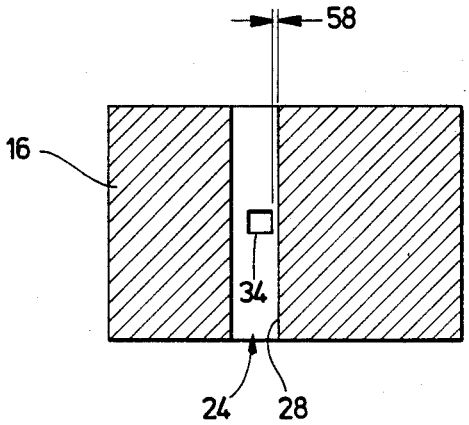
FIG. 4C is a sectional view of FIG. 4A along line A—A, showing an orifice of substantially square cross-section.

FIG. 4C shows a square cross-section orifice. Cylindrical guage pins 56 may also be used with this configuration, but rectangular cross-section orifices will usually require rectangular gauge pins. While orifice 34 may either have a round or rectangular cross-section, preferably the dimension of the fluid orifice perpendicular to the long dimension of yarn passageway 24 is at least 80% of the width of yarn passageway 24. Any smaller relationship will produce stagnant zones within yarn passage 24 where the air turbulence and entangling action are nonuniform. The edge of fluid orifice 34 is preferably sharp where air exits the orifice and enters yarn passage 24. The lower end of fluid orifice 34 where air enters may be chamfered conically, or it may preferably have a short conical section which expands upward with an included angle of 15° for a distance of about ⅛ inch (B 3.2 mm).

Figure 3C:
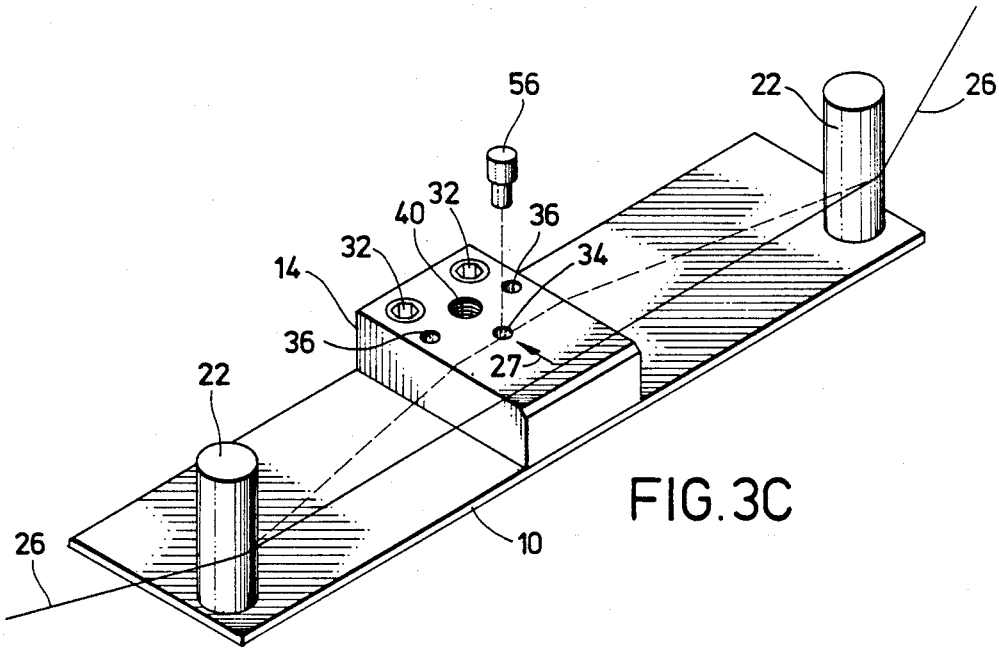
FIG. 3C shows details of an orifice plate and a gauge pin used to adjust the position of the yarn passage groove with respect to the fluid orifice.

To string up the device, yarn 26, which may be running in either direction, is in a position shown by the solid line in FIG. 3C and is either contacting the upper surface of orifice plate 14 or is preferably slightly above. The cap assembly, which includes parts 16, 18 and 20, is brought down until alignment pins 38 enter alignment pin holes 36, and yarn 26 is guided into yarn passage groove 24 by moving it in the direction indicated by arrow 27. Tee handle 20 is then screwed into tee screw hole 40 to complete the assembly. The device may be strung up "on the run" quite easily by loosening tee handle 20 in tee screw hole 40, raising adjustable yarn passage plate 16 and cap plate 18 above the upper surface of orifice plate 14 by an amount sufficient to allow the yarn to pass into yarn passage groove 24, guiding the yarn into said groove, lowering the cap assembly and tightening tee handle 20. A string-up tool may be used in this procedure if desired.

The process of this invention may be operated under conditions normal to one skilled in the art to produce yarns having excellent inter-mingling and along-end uniformity. When practiced with yarns of different color shades, the heather yarns produced exhibit superior color-blending.

We claim:

1. A fluid-jet apparatus for entangling yarn comprising:

(a) a block having an elongated passageway through which yarn can move, said passageway being defined by an entrance and an exit connected by at least two walls, said walls being situated substantially at right angles to one another;

(b) means for maintaining the yarn against one of said walls as said yarn enters, moves through, and exits the passageway; and (c) an orifice in the block for directing a fluid stream into said passageway, said fluid stream discharging from the passageway through both the entrance and the exit, wherein the orifice is located in the second of said walls and is positioned so as to be offset with respect to the longitudinal axis of the passageway in the direction of the first of said walls.

2. The apparatus of claim 1 wherein the passageway is substantially rectangular in cross-section.

3. The apparatus of claim 1 or 2 wherein the orifice is substantially circular in cross-section.

4. The apparatus of claim 1 or 2 wherein the orifice is substantially rectangular in cross-section.

5. A process for entangling yarns comprising the steps of:

(a) over-feeding yarn through a walled passageway defined by at least two walls, said walls being situated substantially at right angles to one another;

(b) directing the yarn along the first of said walls as it enters, moves through, and exits said passageway; and (c) exposing the yarn in the passageway to a fluid stream, said fluid stream being introduced into the passageway through the second of said walls and being offset from the center line of the yarn travel path in the direction of the first of said walls.

6. The process of claim 5 where the yarn is nylon.

7. The process of claim 5 where the yarn is polyester.

8. The process of claim 5 where the yarn is polypropylene.

* * * * *